United States Patent [19]

Battrell

[11] 4,292,035

[45] Sep. 29, 1981

[54] FABRIC SOFTENING COMPOSITIONS

[75] Inventor: Charles F. Battrell, Ft. Mitchell, Ky.

[73] Assignee: The Procter & Gamble Company, Cincinnati, Ohio

[21] Appl. No.: 962,452

[22] Filed: Nov. 20, 1978

Related U.S. Application Data

[63] Continuation-in-part of Ser. No. 960,147, Nov. 13, 1978, abandoned.

[51] Int. Cl.[3] ..... B08B 3/00; C11D 1/18

[52] U.S. Cl. ..... 8/137; 252/8.6; 252/8.8; 252/89.1; 252/117; 252/547

[58] Field of Search ..... 8/137; 252/8.6, 8.8, 252/89.1, 117, 547

[56] References Cited

U.S. PATENT DOCUMENTS

| | | | |
|---|---|---|---|
| 2,531,427 | 11/1950 | Hauser | 252/140 |
| 2,746,887 | 5/1956 | O'Neil | 428/396 |
| 2,805,993 | 9/1957 | Barnard et al. | 252/8.8 |
| 3,594,212 | 7/1971 | Ditsch | 117/62 |
| 3,852,211 | 12/1974 | Ohren | 252/110 |
| 3,862,058 | 1/1975 | Nirschl et al. | 252/528 |
| 3,886,075 | 5/1975 | Bernardino | 252/8.75 |
| 3,920,565 | 11/1975 | Morton | 252/8.75 |
| 3,936,537 | 2/1976 | Baskerville et al. | 427/242 |
| 3,948,790 | 4/1976 | Speakman | 252/120 |
| 3,954,632 | 5/1976 | Gloss | 252/8.8 |
| 3,959,155 | 5/1976 | Montgomery et al. | 252/8.8 |
| 3,966,629 | 6/1976 | Dumbrell | 8/137 |
| 3,993,573 | 11/1976 | Gloss | 252/89 R |
| 4,035,307 | 7/1977 | Fry et al. | 252/8.6 |
| 4,062,647 | 12/1977 | Storm et al. | 8/137 |
| 4,081,496 | 3/1978 | Finlayson | 260/864 |

FOREIGN PATENT DOCUMENTS

| | | |
|---|---|---|
| 861436 | 3/1978 | Belgium . |
| 881407 | 9/1971 | Canada . |

*Primary Examiner*—A. Lionel Clingman

*Attorney, Agent, or Firm*—George Galanes; Thomas H. O'Flaherty; Richard C. Witte

[57] ABSTRACT

Fabric softening compositions are described containing a combination of an anionic surfactant and a complex of certain smectite clays with certain organic amines and their salts and certain quaternary compounds.The compositions provide fabric softening to laundered fabrics during the rinsing operation or can be incorporated into detergent compositions to provide fabric softening through the wash.

23 Claims, No Drawings

FABRIC SOFTENING COMPOSITIONS

TECHNICAL FIELD

RELATED APPLICATION

This application is a continuation-in-part of U.S. application, Ser. No. 960,147 filed Nov. 13, 1978, now abandoned.

This invention relates to solid compositions and methods for conditioning fabrics in home laundering operations. Compositions and methods are disclosed which provide for conditioning fabrics in through-the-wash laundering operations as well as during the rinse cycle of home laundering operations. It is a common practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer.

It has become commonplace today for homemakers to use fabric conditioning compositions. A common practice is to use fabric conditioning compositions for use in the rinse cycle which comprise major amounts of water, lesser amounts of fabric conditioning agents and minor amounts of optional ingredients such as perfumes, colorants, preservatives and stabilizers. Such compositions can be conveniently added to the rinsing bath of home laundry operations. An alternative method is to provide laundering compositions containing the fabric conditioning agent which deposits on the fabric and is carried through the wash and rinse cycles to provide the fabric conditioning property on the dried fabric.

BACKGROUND ART

The use of organic cationic fabric softeners is known. Blomfield in U.S. Pat. No. 3,095,373 discloses cationic chemical compounds having at least one hydrophobic chain having at least 16 carbon atoms for use as softening agents for laundered fabrics.

The use of clays as softening agents is also known. A number of kinds of clay have been suggested for use in detergent compositions for many years, for example, British Pat. Nos. 401,413, Mariott, accepted Nov. 16, 1933 and 461,221, Marriott et al, accepted Feb. 12, 1937 disclose the use of colloidal bentonite in synthetic detergent compositions, built or unbuilt, intended for the washing of hair, textiles, or hard surfaces. More recently British Pat. No. 1,400,898, Storm and Nirschl, sealed Nov. 19, 1975 disclosed the use of certain smectite clays in built detergent compositions to provide through-the-wash fabric softening, and British Pat. No. 1,401,726, Ohren, sealed Nov. 25, 1975 disclosed the use of those clays in soap compositions containing a minor amount of synthetic detergents as curd dispersants. Other prior art references have disclosed the use of clay in washing compositions to provide other benefits, such as builder, water-softener, anticaking agent, suspending agent, soil release agent, hair fulling agent, and filler.

The use of clay and organic cationic fabric softening ingredient combinations in detergent compositions for the simultaneous purpose of cleaning and softening fabrics, in addition to other auxiliary benefits, such as static control, is also known. Bernardino in U.S. Pat. No. 3,886,075 discloses compositions comprising particular smectite clays, cationic anti-static agents and certain substituted amino compatibilizing agents which are detergent compatible and provide softening and antistatic benefits to fabrics washed therein. Speakman in U.S. Pat. No. 3,948,790 discloses detergent compositions containing short chain quaternary ammonium clays which are effective in providing fabric softening with non-ionic detergents.

In general, it has been recognized that while certain clays do provide fabric softening, such softening is of a dry character and limited in softening ability in relation to the more conventional organic cationic fabric softener.

Organic cationic softening agents provide a desirable soft and lubricious feel to the fabrics but their use is typically limited to those chemicals that are readily soluble/dispersible in the homemaker's laundering process and have an affinity for fabric deposition. The organic cationic softening chemicals meeting these criteria tend to be incompatible with anionic surfactants and thus have generally been employed in the rinsing laundering process or in the mechanical dryer. Softening performance in the rinsing process because of this incompatibility is likely to be a function of the anionic detergents carried over from the wash process, and this is likely to be variable.

DISCLOSURE OF THE INVENTION

The present invention relates to fabric conditioning compositions in solid form for use in the home laundering process. These compositions comprise three essential components: (a) from about 10% to about 80%, preferably from 20% to about 60% of a smectite clay; (b) from about 1% to about 50%, preferably from about 3% to about 30%, most preferably from 5% to 20%, based on the clay component, of a fabric softening agent complexed with the clay wherein the fabric softening agent is selected from the group consisting of organic primary, secondary, and tertiary amines and their water soluble or water dispersible salts, and organic quaternary ammonium, phosphonium and sulfonium compounds; and (c) an anionic surfactant which is interacted with the complex and is present in at least 30% molar equivalence to the organic fabric softening agent. The organo-clay softener complex is hydrophobic but the presence of the anionic surfactant provides wetting and dispersion of the complex in an aqueous medium thus allowing for good fabric deposition and subsequently resulting in good, consistent fabric softening performance of the desired lubricious character.

These novel compositions are to provide fabric softening in the rinsing operation of typical laundering processes or can be admixed or incorporated into granular or solid detergent cleaning formulations to provide through the wash fabric softening. The compositions of this invention additionally provide improved grease/oily soil removal from fabrics, especially polyester, treated with the complex.

DETAILED DESCRIPTION OF THE INVENTION

The Clay

The first of the three essential ingredients of this invention is smectite clay. The clay is complexed with the organic fabric softening agent to provide the fabric conditioning utility. Smectite clay is present in the granular fabric conditioning composition at levels from about 10% to about 80%, preferably from about 20% to about 60%, by weight of the composition.

The clay minerals used to provide part of the softening properties of the instant compositions can be described as impalpable, expandable, three-layer clays, in which a sheet of aluminum/oxygen atoms or magnesium/oxygen atoms lies between two layers of silicon-/oxygen atoms, i.e., alumino-silicates and magnesium silicates, having an ion exchange capacity of at least 50 meq./100 g. of clay. The term "impalpable" as used to describe the clays employed herein means that the individual clay particles are of such a size that they cannot be perceived tactilely. Such particles sizes are within the range below about 100 microns in effective diameter. In general, the clays herein have an ultimate particle size within the range from about 1 micron to about 50 microns. The term "expandable" as used to describe clays relates to the ability of the layered clay structure to be swollen, or expanded, on contact with water. The three-layer expandable clays used herein are examples of the clay minerals classified geologically as smectites.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0. Of these only montmorillonites having exchange capacities greater than 50 meq/100 g. are suitable for the present invention and provide fabric softening benefits.

The tioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)(MG_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0. Hectorite and saponite are the only minerals in this class that are of value in the present invention, the static reduction or fabric softening performance being related to the type of exchangeable cation as well as to the exchange capacity.

The smectite clays useful in the present invention are hydrophilic in nature, i.e. they display swelling characteristics in aqueous media.

It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure.

As noted hereinabove, the clay minerals employed in the compositions of the instant invention contain cationic counterions such as protons, sodium ions, potassium ions, calcium ions, magnesium ions, lithium ions, and the like. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite clay is expressed by the following equation:

$$\text{smectite clay (Na)} + NH_4OH \rightleftharpoons \text{smectite clay } (NH_4) + NaOH$$

Since in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay(meq./100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which in turn, is determined at least in part by the lattice structure, and the like. The ion exchange capacity of clays varies widely in the range from about 2 meq/100 g. for kaolinites to about 150 meq/100 g., and greater, for certain smectite clays. Illite clays although having a three layer structure, are of a non-expanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrous linked together by octahedral groups of oxygens and hydroxyls containing Al and Mg atoms.

It has been determined that illite, attapulgite, and kaolinite clays, with their relatively low ion exchange capacities, are not useful in the instant compositions. However the alkali metal montmorillonites, saponites, and hectorites and certain alkaline earth metal varieties of these minerals such as calcium and sodium montmorillonites have been found to show useful fabric softening benefits when incorporated in compositions in accordance with the present invention.

Specific non limiting examples of such fabric softening smectite clay minerals are:

Sodium Montmorillonite

Brock
Volclay BC
Gelwhite GP
Thixo-Jel #1
Ben-A-Gel

Sodium Hectorite

Veegum F
Laponite SP

Sodium Saponite

Barasym NAS 100

Calcium Montmorillonite

Soft Clark
Gelwhite L

Lithium Hectorite

Barasym LIH 200

Most of the smectite clays useful in the compositions herein are commercially available under various tradenames, for example, Thixo-Jel #1 and Gelwhite GP from Georgia Kaolin Co., Elizabeth, N.J.; Volclay BC and Volcaly #325, from American Colloid Co., Skokie, Ill.; and Veegum F, from R. T. Vanderbilt. It is to be recognized that such smectite minerals obtained under the foregoing tradenames can comprise mixtures of the various discrete mineral entities. Such mixtures of the smectite minerals are suitable for use herein.

Within the classes of montmorillonite, hectorite, and saponite clay minerals having a cation exchange capacity of at least about 50 meq/100 g., certain clays are preferred for fabric softening purposes. For example, Gelwhite GP is an extremely white form of smectite clay and is therefore preferred when formulating white or lightly colored agglomerates. Volclay BC which is a smectite clay mineral containing at least 3% of iron (expressed as $Fe_2O_3$) in the crystal lattice, and which has a very high ion exchange capacity, is one of the most efficient and effective clays for use in agglomerated fabric conditioning compositions and is preferred from the standpoint of product performance. On the other hand, certain smectite clays marketed under the name "bentonite" are sufficiently contaminated by other silicate minerals, as evidenced by a low colloid content ($\approx$50%) that their ion exchange capacity falls below the requisite range, and such clays are of no use in the instant compositions.

Bentonite, in fact, is a rock type originating from volcanic ash and contains montmorillonite (one of the smectite clays) as its principal clay component. The Table shows that materials commercially available under the name bentonite can have a wide range of cation exchange capacities and fabric softening performance.

Mixtures of two or more types of clay are contemplated within the scope of this invention.

| BENTONITE | EXCHANGE CAPACITY meg/100 g. | SOFTENING ABILITY |
|---|---|---|
| Brock[1] | 63 | Good |
| Soft Clark | 84 | Good |
| Bentolite L[1] | 68 | Fair–Good |
| Clarolite T-60[1] | 61 | Fair |
| Granulare | | |
| Naturale Bianco[2] | 23 | Fair–Poor |
| Thixo-Jel #4[1] | 55 | Poor* |
| Granular | | |
| Naturale Normale | 19 | Poor |
| Clarsol FB 5[3] | 12 | Poor |
| PDL 1740[1] | 26 | None |
| Versuchs | | |
| Product FFI[4] | 26 | None |

SUPPLIER
[1]Georgia Kaolin Co. USA
[2]Seven C. Milan Italy
[3]Ceca Paris France
[4]Sud-Chemie Munich Germany
*Low colloid content ($\approx$50%)

It has also been found that certain smectite minerals can reduce or eliminate the buildup of static electricity on fabrics washed in the compositions. The visible evidence that static buildup has been prevented is the absence of "cling", i.e., the tendency of different areas of fabric to adhere to one another. A measure of the approach to static charge elimination is the mean voltage of the fabric.

The smectite minerals that have proved to be beneficial in reducing static buildup when incorporated into agglomerated fabric conditioning compositions are the lithium and magnesium hectorites and saponites, i.e., minerals of the structure $(OH)_4Si_{8-y}Al_y(Mg_{6-x}Li_x)O_{20}$ and $(OH)_4Si_{8-y}Al_yMg_{6-x}Al_xO_{20}$ respectively in which the counter ions are predominantly magnesium or lithium, i.e., at least 50% of the counter ions are $Li^+$ or $Mg^{++}$, the remainder being other alkaline earth or alkali metal counter ions.

Preferred minerals are those in which 75–90% of the counter ions are lithium or magnesium and for which the cation exchange capacities are greater than 60 meq/100 g. Specific examples of such preferred materials are magnesium hectorite, lithium hectorite, and magnesium saponite.

It is believed that the universal benefit given by the $Mg^{++}$ and $Li^+$ hectorite and saponite clay minerals is related to the size to charge ratio of these cations and the unusually large number of moles of water that can be held by them.

Minerals that have fabric softening characteristics such as the sodium and calcium montmorillonites and the sodium hectorites and saponites do not exhibit appreciable antistatic activity, nor does magnesium montmorillonite.

Accordingly, smectite clays useful in the fabric conditioning compositions of this invention can be characterized as montmorillonite, hectorite, and saponite clay minerals having an ion exchange capacity of at least about 50 meq/100 g. and preferably at least 60 meq/100 g.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite minerals for use in the granular fabric conditioning compositions disclosed herein.

The smectite clays described hereinabove function as fabric conditioning agents by depositing on fiber surfaces, particularly cotton surfaces that are negatively charged. They are effective, not only on the surfaces of 100% cotton fabric, but also upon fabric blends that contain significant amounts of cotton, for example a 50% cotton/50% polyester blend. The discrete, individual smectite clay particles are in the form of flat platelets, having a predominantly positive charge around the edges where the crystal lattices are incomplete, and having a predominantly negative charge on the flat sides thereof.

The Organic Fabric Softening Agent

The second essential ingredient of this invention is the organic fabric softening agent which is reacted with the clay to form the water insoluble complex. The organic fabric softening agent is present in compositions of this invention at levels of from 1% to 50% of the clay component. Preferred levels range from 3% to 30%, most preferred 5% to 20%, of the clay component.

In general, useful softeners are organic compounds which contain primary, secondary, tertiary or quaternary nitrogen or which are phosphonium or sulfonium compounds and have at least one relatively long hydrocarbon group substituent conferring hydrophobicity and lubricity. Typical fabric softeners include A. Primary, secondary and tertiary amines and their water soluble or water dispersible salts and quaternary ammonium compounds. The general formulas for this group are $R_1R_2R_3N$;

$[R_1R_2R_3R_4N]_n{}^+X^{n-}$ wherein $R_1$ represents an alkyl or alkenyl having from about 8 to about 22 carbon atoms and $R_2$, $R_3$ and $R_4$ each independently represent hydrogen or alkyl, alkenyl, arylalkyl or alkylaryl having from 1 to 22 carbon atoms, and $X^-$ represents a water soluble or water dispersible anion and n is an integer from 1 to 3, preferably 1 to 2. Examples of suitable anions include hydroxide, chloride, bromide, sulfate, methosulfate or similar anion.

Examples of the above include primary tallow amine, primary coconut amine, secondary dilauryl amine, secondary tallow methyl amine, tallow dimethyl amine, coconut dibutyl amine, trilauryl amine, tritallow amine, primary tallow amine hydrochloride, primary coconut amine hydrochloride, monostearyl dimethyl ammonium chloride, trioleyl ammonium chloride, dicoconut dimethyl ammonium chloride, tallow trimethyl ammonium chloride, ditallow dimethyl ammonium chloride, tetralauryl ammonium chloride, tetratallow ammonium chloride, ditallow methyl amine, ditallow methyl ammonium chloride and tallow dimethyl ammonium chloride.

B. The diamine and diammonium salts having the general formulas $R_1R_2NR_5NR_3R_4$;

$[R_1R_2NR_5NR_3R_4R_6]_n{}^{+Xn-}$ $[R_1R_2R_3NR_5NR_4R_6]_n{}^+X^{n-}$;

$[R_1R_2R_3NR_5NR_4R_6R_7]^{2+}X^{2-}$ wherein $R_1$, $R_2$, $R_3$, $R_4$, n and $X^-$ are as defined above, $R_6$ and $R_7$ have the same definition as $R_2$ to $R_4$ and $R_5$ is an alkylene chain having from 4 to 6 carbon atoms wherein the middle carbon atoms may be linked to each other by an ether oxygen or by a double or triple bond. Common among the available diamines are N-alkyltrimethylene diamines ($R—NH—C_3H_6—NH_2$). A specific example of a suitable diamine is 2,2'-bis(stearyl dimethyl ammonio) diethylether dichloride.

C. The ethoxylated amine and diamine salts with fatty alkyl groups of coconut, tallow, soya and stearyl having from 2 to 50 moles of ethylene oxide, typically with 2, 5, 15 or 50 moles ethylene oxide, are also suitable.

D. Alkyl imidazoline and imidazole salts wherein the alkyl group is lauryl, oleyl, stearyl, or tall oil, are also suitable for the invention provided the system is not too alkaline. Specific examples of these compounds are 1-beta hydroxyethyl-2-stearyl imidazoline ammonium chloride and 2-stearyl-1, 1-methyl [(2-stearylamido) ethyl]-imidazolinium methosulfate.

E. Yet another suitable softening agent includes alkyl pyridine and piperidine salts wherein the alkyl group has from about 8 to 22 carbon atoms. Examples include stearamidomethyl pyridinium chloride, and stearyl pyridinium chloride.

F. Yet other additional softening agents include alkyl sulfonium and alkyl phosphonium salts wherein the alkyl group has from 8 to 22 carbon atoms. Compounds in this group are quaternized and will combine with the clay. An example of a salt of this type is

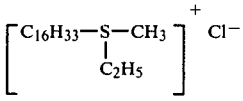

G. Further additional softening agents include esters of amino acids and amino alcohols wherein at least one of the two hydrocarbon chains has from 8 to 22 carbon atoms and the second hydrocarbon chain can be an alkyl having from 1 to 4 carbon atoms or an alkyl having from 8 to 22 carbon atoms.

H. Further additional softening agents include the fatty acid ester salts of mono-, di- and tri-ethanolamine salts, and the alkyl guanidine salts in which the alkyl group contain 8 to 22 carbon atoms.

The suitable organic fabric softening agents will combine with the clay to form a complex including the compounds that are not in salt form. However, it has been found more convenient to first convert compounds, such as the amines, to the salt form before complexing with the clay.

The reaction of the organic cationic softener with the smectite clay proceeds predominantly via an ion exchange mechanism until the cation exchange capacity of the clay is approached and thereafter the mechanism is one of adsorption. The once negatively charged clay particles become increasingly electropositive and with continued adsorption a reversal of charges occurs for the organo-clay complex. The interactions between the clay and the organic cationic softener are strong and change the physical properties of the clay (i.e. viscosity, colloid stability, and the clay becomes hydrophobic).

The complex formed is hydrophobic and different to disperse in a home laundering process. It has been discovered that combining the complex with an anionic surfactant provides a composition in a solid form which is wetted and dispersed in an aqueous medium which allows for good deposition of the complex onto the fabric.

The Anionic Surfactant

The third essential ingredient of this invention is the anionic surfactant which is used to combine with the organo-clay complex to provide wetting and dispersibility for the complex. The anionic surfactant is present at levels of at least about 30% molar equivalence to the organic softening agent; levels of about 50% to about molar equivalence to the organic softening agent are preferred and anionic surfactant levels present in slightly greater than molar equivalence are most preferred for wetting and dispersion of the complex. Anionic surfactant levels much above the molar equivalence of the organic softening agent are not detrimental to achieving good wetting and dispersion but are undesirable when the compositions of this invention are directed to use in the rinse.

Water-soluble salts of the higher fatty acids, i.e., "soaps" are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by neutralization of free fatty acids. Particularly useful are the sodium and potassium salts of the mixtures of fatty acids, derived from coconut oil and tallow, i.e., sodium or potassium tallow and coconut soaps.

The anionic synthetic surfactants suitable for this invention include water-soluble salts, particularly the alkali metal salts, or organic sulfuric reaction products having in their molecular structure an alkyl group containing from about 8 to about 22 carbon atoms and a moiety selected from the group consisting of sulfonic acid and sulfuric acid ester moieties. (Included in the term alkyl is the alkyl portion of higher acyl moieties.)

Examples of this group of synthetic surfactants which form a part of the softener compositions of the present invention are the sodium and potassium alkyl sulfates, especially those obtained by sulfating the higher alcohols ($C_8$–$C_{18}$ carbon atoms) produced by reducing the glycerides of the tallow or coconut oil; sodium and potassium alkyl benzene or toluene sulfonates in which the alkyl group contains from about 9 to about 20, 9 to 15 preferred, carbon atoms in straight chains or branched-chain configuration, e.g. those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS); sodium alkyl glyceryl ether sulfonates, especially those ethers of higher alcohols derived from tallow and coconut oil; sodium coconut oil fatty acid monoglyceride sulfonates and sulfates; sodium and potassium salts of sulfuric acid esters of the reaction product of one mole of a higher fatty alcohol (.e.g. tallow or coconut oil alcohols) and about 1 to 6 moles of ethylene oxide; sodium and potassium salts of alkyl phenol ethylene oxide ether sulfates with about 1 to about 10 units of ethylene oxide per molecule and in which the alkyl groups contain from about 8 to about 12 carbon atoms.

Anionic phosphate surfactants are also useful in the present invention. These are surface active materials in which the anionic solubilizing group connecting hydrophobic moieties is an oxy acid of phosphorus. The more common solubilizing groups, of course are —$SO_4H$ and —$SO_3H$. Alkyl phosphate esters such as $(R—O)_2PO_2H$ and $ROPO_3H_2$ in which R represents an alkyl chain containing from about 8 to about 20 carbon atoms are useful herein.

These phosphate esters can be modified by including in the molecule from one to about 40 alkylene oxide units, e.g., ehtylene oxide units. Formulae for these modified phosphate anionic surfactants are

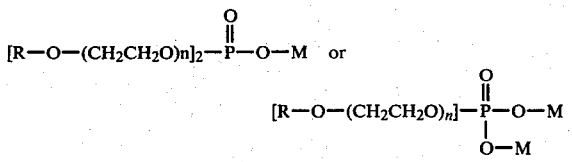

in which R represents an alkyl group containing from about 8 to 20 carbon atoms, or an alkylphenyl group in which the alkyl group contains from about 8 to about 20 carbon atoms, and M represents a soluble cation such as hydrogen, sodium, potassium, ammonium or substituted ammonium; and in which n is an integer from 1 to about 40.

Another class of suitable anionic organic surfactants particularly useful in this invention includes salts of 2-acyloxy-alkane-1-sulfonic acids. These salts have the formula

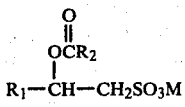

where $R_1$ is alkyl of about 9 to about 23 carbon atoms (forming with the two carbon atoms an alkane group); $R_2$ is alkyl of 1 to about 8 carbon atoms; and M is a water-soluble cation.

The water-soluble cation, M, in the hereinbefore described structural formula can be, for example, an alkali metal cation (e.g., sodium, potassium, lithium), ammonium or substituted-ammonium cation. Specific examples of substituted ammonium cations include methyl-, dimethyl-, and trimethyl- ammonium cations and quaternary ammonium cations such as tetramethylammonium and dimethyl piperidinium cations and those derived from alkylamines such as ethylamine, diethylamine, triethylamine, mixtures thereof, and the like.

Specific examples of beta-acyloxy-alkane-1-sulfonates, or alternatively 2-acyloxy-alkanel-1-sulfonates, useful herein include the sodium salt of 2-acetoxy-tridecane-1-sulfonic acid; the potassium salt of 2-propionyloxy-tetradecane-1-sulfonic acid; the lithium salt of 2-butanoyloxy-tetradecane-1-sulfonic acid; the sodium salt of 2-pentanoyloxy-pentadecane-1-sulfonic acid; the sodium salt of 2-acetoxy-hexadecane-1-sulfonic acid; the potassium salt of 2-octanoyloxy-tetradecane-1-sulfonic acid; the sodium salt of 2-acetoxy-heptadecane-1-sulfonic acid; the lithium salt of 2-acetoxy-octadecane-1-sulfonic acid; the potassium salt of 2-acetoxy-nonadecane-1-sulfonic acid; the sodium salt of 2-acetoxy-uncosane-1-sulfonic acid; the sodium salt of 2-propionyloxy-docosane-1-sulfonic acid; the isomers thereof.

Examples of beta-acyloxy-alkane-1-sulfonate salts herein are the alkali salts of beta-acetoxy-alkane-1-sulfonic acids corresponding to the above formula wherein $R_1$ is an alkyl of about 12 to about 16 carbon atoms.

Typical examples of the above described beta-acetoxy alkanesulfonates are described in the literature: Belgium Pat. No. 650,323 issued July 9, 1963, discloses the preparation of certain 2-acyloxy alkanesulfonic acids. Similarly, U.S. Pat. Nos. 2,094,451 issued Sept. 28, 1937, to Guenther et al. and 2,086,215 issued July 6, 1937, to DeGroote disclose certain salts of beta-acetoxy alkanesulfonic acids. These references are hereby incorporated by reference.

Another preferred class of anionic surfactant compounds herein is the alkylated α-sulfocarboxylates, containing about 10 to about 23 carbon atoms, and having the formula

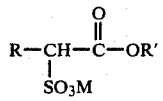

wherein R is $C_8$ to $C_{20}$ alkyl, M is a water-soluble cation as hereinbefore disclosed, preferably sodium ion, and R′ is short-chain alkyl, e.g., methyl, ethyl, propyl, and butyl. These compounds are prepared by the esterification of α-sulfonated carboxylic acids, which are commercially available, using standard techniques. Specific examples of the alkylated α-sulfocarboxylates preferred for use herein include:

ammonium methyl-α-sulfopalmitate,
triethanolammonium ethyl-α-sulfostearate,
sodium methyl-α-sulfopalmitate,
sodium ethyl-α-sulfopalmitate,
sodium butyl-α-sulfostearate,
potassium methyl-α-sulfolaurate,
lithium methyl-α-sulfolaurate, as well as mixtures thereof.

Another class of anionic organic surfactants is the β-alkyloxy alkane sulfonates. These compounds have the following formula:

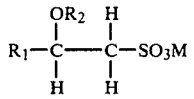

where $R_1$ is a straight chain alkyl group having from 6 to 20 carbon atoms, $R_2$ is a lower alkyl group having from 1 (preferred) to 3 carbon atoms, and M is a water-soluble cation as hereinbefore described.

Specific examples of β-alkyloxyl alkane sulfonates, or alternatively 2-alkyloxy-alkane-1-sulfonates, having low hardness (calcium ion) sensitivity useful herein to provide superior cleaning levels under household washing conditions include:

potassium-β-methoxydecanesulfonate,
sodium 2-methoxytridecanesulfonate,
potassium 2-ethoxytetradecylsulfonate,
sodium 2-isopropoxyhexadecylsulfonate,
lithium 2-t-butoxytetradecylsulfonate,
sodium β-methoxyoctadecylsulfonate, and
ammonium β-n-propoxydodecylsulfonate Other synthetic anionic surfactants useful herein are alkyl ether sulfates. These materials have the formula $RO(C_2H_4O)_xSO_3M$ wherein R is alkyl or alkenyl of about 10 to about 20 carbon atoms, x is 1 to 30, and M is a water-soluble cation as defined hereinbefore. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 6, molar proportions of ethylene oxide and the resulting mixture of molecular species, having, for example, an average of 6 moles of ethylene oxide per mole of alcohol, is sulfated and neutralized.

Specific examples of alkyl ether sulfates of the present invention are sodium coconut alkyl ethylene glycol ether sulfate, lithium tallow alkyl triethylene glycol ether sulfate; and sodium tallow alkyl hexaoxyethylene sulfate.

Preferred alkyl ether sulfates (commonly abbreviated as $AE_xS$) are the alkali metal coconut- and tallow-alkyl oxyethylene ether sulfates having an average of about 1 to about 10 oxyethylene moieties. The alkyl ether sulfates of the present invention are known compounds and are described in U.S. Pat. No. 3,332,876, to Walker (July 25, 1967), incorporated herein by reference.

Additional examples of anionic non-soap synthetic surfactants which come within the terms of the present invention are the reaction product of fatty acids esterified with isethionic acid and neutralized with sodium hydroxide where, for example, the fatty acids are derived from coconut oil; sodium or potassium salts of fatty acid amides of methyl tauride in which the fatty acids, for example, are derived from coconut oil. Other anionic synthetic detergents of this variety are set forth in U.S. Pat. Nos. 2,486,921; 2,486,922; and 2,396,278.

Additional examples of anionic, non-soap, synthetic surfactants, which come within the terms of the present invention, are the compounds which contain two anionic functional groups. These are referred to as di-anionic detergents. Suitable di-anionic surfactants are the disulfonates, disulfates, or mixtures thereof of which may be represented by the following formulae:

$R(SO_3)_2M_2$,
$R(SO_4)_2M_2$,
$R(SO_3)(SO_4)M_2$, where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium-1,2-alkyldisulfonates, disodium 1,9-stearyldisulfates and 6,10-octadecyldisulfates.

The aliphatic portion of the disulfates or disulfonates is generally substantially linear, thereby imparting desirable biodegradable properties to the surfactant compound.

The water-solubilizing cations include the customary cations known in the detergent art, i.e., the alkali metals, and the ammonium cations, as well as other metals in group IIA, IIB, IIIA, IVA and IVB of the Periodic Table except for boron. The preferred water-solubilizing cations are sodium or potassium. These dianionic surfactants are more fully described in British Pat. No. 1,151,392 which claims priority on an application made in the United States of America (No. 564,556) on July 12, 1966.

Still other anionic synthetic surfactants include the class designated as succinamates and succinates. This class includes such surface active agents as disodium N-octadecylsulfo-succinamate; tetrasodium N-(1,2-dicarboxyethyl)-N-octadecylsulfo-succinamate; diamyl ester of sodium sulfosuccinic acid; dihexyl ester of sodium sulfosuccinic acid; dioctyl esters of sodium sulfosuccinic acid.

Other suitable anionic surfactants utilizable herein are olefin sulfonates having about 12 to about 24 carbon atoms.

The α-olefins from which the olefin sulfonates are derived are mono-olefins having 12 to 24 carbon atoms, preferably 14 to 16 carbon atoms. Preferably, they are straight chain olefins. Examples of suitable 1-olefins include 1-dodecane; 1-tetradecene; 1-hexadecene; 1-octadecene; 1-eicosene and 1-tetracosene.

In addition to the true alkene sulfonates and a proportion of hydroxy-alkanesulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific anionic surfactant which has also been found excellent for use in the present invention is described more fully in the U.S. Pat. No. 3,332,880 of Phillip F. Pflaumer and Adrian Kessler, issued July 25, 1967, titled "Detergent Composition", the disclosure of which is incorporated herein by reference.

Of all the above-described types of anionic surfactants, preferred compounds include sodium linear alkyl benzene sulfonate wherein the alkyl chain averages from about 10 to 18, more preferably about 12, carbon atoms in length, sodium tallow alkyl sulfate; 2-acetexytridecane-1-sulfonic acid; sodium methyl-α-sulfopalmitate; sodium β-methoxyoctadecylsulfonate; sodium coconut alkyl ethylene glycol ether sulfonate; the sodium salt of the sulfuric acid ester of the reaction product of one mole of tallow alcohol and three moles of ethylene oxide; and mixtures thereof.

The suitable anionic surfactants are combined with the organo-clay complex, usually in an aqueous medium. The anionic surfactant is believed to sorb onto the surface of the complex. In any event the anionic surfactant provides the required wetting and dispersion of the complex.

In making a detergent composition having the fabric softening properties of this invention, the organo-clay complex is added to the other ingredients of the detergent composition, which includes an anionic surfactant, to combine the organo-clay complex with the anionic surfactant in situ rather than as a separate step.

Optional Ingredients

The softener composition need only include the three essential ingredients. The composition can also include from 2% to about 75%, preferred 5% to 60%, most preferred 10% to 50%, of water soluble fillers. The fillers include inorganic and organic materials. Such fillers include sodium carbonate, sodium bicarbonate sodium sesquicarbonate, urea, sodium sulfate, sodium borate, magnesium sulfate, sodium chloride, and mixtures thereof. These fillers can also act as processing aids in making the softener composition of the invention.

Additional optional ingredients include from 0.1% to about 9%, preferred 0.5% to 3%, of sodium toluene sulfonate and/or sodium xylene sulfonate as processing aids for the anionic surfactant.

Additional optional ingredients include minor amounts, of from 0.01% to about 1%, of colorant, perfume, fabric brighteners, bleaching agent, and the like.

Processing

The softener composition is made by combining the three essential ingredients in two basic steps.

In the first step the smectite clay is contacted with the organic softener to form the organo-clay complex. This step is conveniently carried out in an aqueous system. The complex will form at ambient temperatures especially if the organic softener is in the salt form. If the organic softener is not in the salt form and is a solid then the softener should be melted before addition to the clay to conveniently form the complex. Temperatures up to about 80° C. can conveniently be employed in making the organo-clay complex.

In the second step the organo-clay complex is contacted with the anionic surfactant. This step is also conveniently carried out in an aqueous system.

The above order of addition is fundamental to the instant invention. It is important that the organic softener be in a combined state with the clay prior to addition of the anionic surfactant otherwise the organic softener will be neutralized by the anionic surfactant and will result in lessening the softener contribution expected from the organic softener.

The techniques for making the compositions of the present invention in the form of a granule are well known. They range from those using a small amount of water to those using a considerable amount of water. Specifically one method of making a granular composition is by agglomeration. A slurry of organic softener can be sprayed onto the clay particles to form the complex which step is then followed by spraying onto the complex a slurry of the anionic surfactant.

Non-limiting examples of the equipment available for agglomeration include a cement mixer, Dravo pan agglomerator, KG/Schugi Blender-Granulator whirling knife continuous vertical fluidized bed agglomerator, Niro Fluidized Bed and Obrian Mixer/Agglomerator.

Other methods and equipment which use larger amounts of water include a spray drying tower, prilling tower, roll dryer and extrusion processes.

In the process of making the softener compositions a convenient place to add the optional ingredients such as colorants, perfume, and fillers is after the organo-clay complex is formed and before and/or after the addition of the anionic surfactant. The optional ingredients can serve as processing aids.

The particle size of the granules, whether made by agglomeration or by spray drying will vary. The preferred size for use of the fabric softener compositions of this invention in the granular form is from about 20 mesh to about 65 mesh (Tyler).

As disclosed herein the softener composition comprising the three essential ingredients is intended for use in providing softening for fabrics during the rinsing operation which follows washing. Alternatively the fabric softener compositions can simply be admixed with a detergent composition or added to a washing solution to provide fabric softening through the wash.

Detergent Compositions

Another modification is to formulate a detergent composition having the fabric softening properties of this invention. In this event the organo-clay complex in combination with the anionic surfactant is added to the other ingredients of the detergent composition during the making process. Alternatively, for a detergent composition whose surfactant is predominantly or wholly anionic, the organo-clay complex can be added to the mixture of ingredients to combine the complex with the anionic surfactant in situ during mixing of the ingredients rather than as a separate, preliminary step.

For through the wash softening, the sodium smectite clays are preferred.

The solid compositions referred to include granular and solid bar compositions.

In fully developed detergent compositions, the softener composition comprising the three essential components and which is a component of the detergent composition, will be present in an amount of from about 10% to about 50%, preferably from about 20% to about 40%, by weight of the total composition. The remainder of the composition will comprise from 1% to about 50% by weight, preferably 10 to 30% by weight of a detersive surfactant which is an anionic sufactant or predominantly anionic with minor amounts of nonionic, ampholytic and zwitterionic surfactants and mixtures thereof, and about 10% to about 60%, preferably from 20% to 45% by weight of a detergency builder, together with other conventional detergent ingredients.

Surfactants

As stated hereinabove the surfactants suitable for use in a through the wash detergent composition can comprise an anionic surfactant or predominantly anionic with minor amounts of nonionic, ampholytic and zwitterionic surfactants and mixtures thereof.

The suitable anionic surfactants which can be used in a complete detergent composition having fabric softening are those described hereinbefore for making the softener composition.

Preferred nonionic surfactants useful in the present invention are those obtained by the condensation of one to twelve ethylene oxide moieties with a $C_{10}$–$C_{18}$ aliphatic alcohol. The alcohol may be completely linear as occurs in materials derived from the natural feedstocks such as vegetable oils and animal fats, or may be slightly branched as occurs in petroleumderived alcohols made by oxo-type synthesis. Particularly preferred materials are $C_{14}$–$C_{15}$ alcohol condensed with an average of seven ethylene oxide groups. $C_{12}$–$C_{13}$ alcohol condensed with an average of about four ethylene oxide groups and then subjected to stripping to remove unethoxylated and low ethoxylated materials, to leave an ethoxylated having a mean of 4.5 ethylene oxide groups.

Preferred zwitterionic materials are derivatives of quaternary ammonium compounds containing an aliphatic straight chain group of 14–18 carbon atoms and a sulfate or sulfonate anionic solubilizing group. Specific examples include 3-N,N-dimethyl-N-hexadecylammonio-2-hydroxpropane-1-sulfonates; 3-(N,N-dimethyl-N-tallowylammonio)-2-hydroxypropane-1-sulfonate; 3-(N,N-dimethyl-N-tetradecyl amonio)-propane-1-sulfonate; and 6-(N,N-dimethyl-N-hexadecylammonio)-hexanoate.

Detergent Builders

The detergent compositions comprising the instant invention can also contain a detergent builder in an amount from about 10% to 60% by weight, preferably from about 20% to 45% by weight, of the composition. Useful builders herein include any of the conventional inorganic and organic water-soluble builder salts as well as various water-insoluble builders. In the present compositions these water-soluble builder salts serve to maintain the pH of the laundry solution in the range of from about 7 to about 12, preferably from about 8 to about 11. Furthermore, these builder salts enhance the fabric cleaning performance of the overall compositions while at the same time they serve to suspend particulate soil released from the surface of the fabrics and prevent its redeposition on the fabric surfaces.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitriiotriacetates, and N-(2-hydroxyethyl)nitrilodiacetates; (2) water-soluble salts of phytic acid, e.g., sodium and potassium phytates; (3) water-soluble polyphosphonates, including, sodium, potassium and lithium salts of ethane-1-hydroxy-1, 1-diphosphonic acid; sodium potassium, and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic polyvalent anionic builder salts are preferred for use herein from an economic standpoint, the ammonium, alkanolammonium, e.g. triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1, 1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO)_y.xH_2O$ wherein z and y are integers of at least 6, the molar ratio of z to y is in the range from 1.0 to about 0.5 and x is an integer from about 15 to about 264. Compositions incorporating builder salts of this type form the subject of Canadian Pat. No. 1,035,234 granted July 25, 1978, invented by J. M. Cockill, B. L. Madison and M. E. Burns, assigned to The Procter & Gamble Company, the disclosure of which is incorporated herein by reference.

A second water-insoluble aluminosilicate which is useful in the compositions of the invention is an amorphous water-insoluble hydrated compound of the formula $Na_x(xAlO_2.ySiO_2)$, wherein x is a number from 1 to 1.2 and y is 1, said amorphous compound being further characterized by $M_s++$ exchange capacity on an anhydrous basis of from about 50 mg.eq. $CaCO_3$/g (milligrams equivalent of $CaCO_3$ hardness/gram) to about 150 mg.eq. $CaCO_3$/g. (milligrams equivalent of $CaCO_3$ hardness/gram). This ion exchange builder is more fully described in British Pat. No. 1,470,250 sealed Aug. 10, 1977, and incorporated herein by reference.

EXAMPLE I

Test towels consisting of 100% cotton were washed in an upright machine using a regular granular detergent under the following conditions:

| | |
|---|---|
| Product concentration | 0.25% (127.5 g in 13.5 gal. water) |
| Product composition | 20% surfactant (70/30 $C_{12}$ branched alkyl benzene sulfonate/$C_{12}$ branched toluene sulfonate), 33% STPP, 10% silicate solids ($2SiO_2/Na_2O$), 25% $Na_2SO_4$, 2% sodium toluene sulfonate, balance water and miscellaneous. |
| Water hardness | 19 gr/gal, 3/1 Ca/Mg ratio |
| Water temperature | 70–75° F. |
| Water:Cloth ratio | 25 to 1 |
| | Towels of 86% cotton/14% polyester were included with the test towels to make up a full wash load |
| Washing time | 20 minutes |

After washing, the towels were hand wrung and agitated in the washer for 5 minutes in 13.5 gallons of 70° F., 9 grain hardness 3/1 Ca/Mg ratio water to rinse.

Following the first rinse the fabrics were again hand wrung and agitated as in the first rinse except that the second rinse water included the fabric softening compositions as indicated below. The fabrics were then wrung and line dried following which the test fabrics were graded for softness in a round robin panel test. Three judges were employed in the grading using a 0 to 4 grading scale wherein the scale has the following meaning: 0—no difference; 1—guess that there is a difference; 2—small difference; 3—moderate difference; 4—large difference. The compositions tested and the results after two washrinse cycles are given below.

| Softener Composition No. | | No. 1 | No. 2 | No. 3 |
|---|---|---|---|---|
| Complex of Clay - Ca montmorillonite | | 30.0% | 60.0% | 30.0% |
| Primary tallow amine hydrochloride | | 5.0 | 3.0 | 5.0 |
| Branched $C_{12}$ alkylbenzene sulfonate, Na salt | | 9.09 | 4.86 | 9.09 |
| Sodium toluenesulfonate | | 0.91 | 0.49 | 0.91 |
| Sodium carbonate | | — | 15.52 | — |
| Sodium sulfate | | 6.41 | 3.43 | 6.41 |
| Sodium sesquicarbonate (anhyd.basis) | | 37.70 | — | 37.70 |
| Color/Perfume | | 0.6 | — | — |
| Water | | 10.0 | 12.5 | 10.0 |
| Miscellaneous | | Bal. | Bal. | Bal. |
| Amount of product in 2nd rinse - g. | | 50 | 62.5 | 50 |
| Concentration of product | | 0.1% | 0.125% | 0.1% |
| Softness Results | Blank | No. 1 | No. 2 | No. 3 |
| (No softener in the 2nd rinse) | | | | |
| Softness panel score (averaged results) | O(STD) | 2.4 | 3.2 | 2.4 |
| Least significant difference = 0.4 @ 95% confidence | | | | |

Composition No. 1 was a granule made by spray drying. Compositions No. 2 and No. 3 were prepared in an aqueous slurry as follows:

No. 2

1.88 g. of primary tallow amine hydrochloride was dispersed in 500 ml of tap water at 23° C. 37.5 of clay was added and the resultant slurry was mixed for 20 to 30 minutes. The remaining ingredients were predissolved in 250 ml of tap water and the resulting solution was added to the organo-clay complex and the entire mixture was agitated 5 to 10 minutes before applying it during the second rinse.

No. 3

2.5 g. of primary tallow amine hydrochloride was dissolved in tap water at 75° C. 15 g. of the clay was added and mixed for 20 to 30 minutes, the temperature of the mix maintained at 75° C. The remaining ingredients were predissolved in tap water at 75° C. The resulting solution was mixed with the organo-clay complex slurry for 5 to 10 minutes prior to use.

As shown by the results the cotton towels rinsed in solutions of compositions of the invention were significantly softer in feel than cotton towels rinsed in water only.

Substantially similar benefits for the softener compositions were observed when the cotton fabrics were not as carefully rinsed in the first rinse as above wherein the fabrics carried over more anionic surfactant to the second rinsing operation.

EXAMPLE II

The softener composition was evaluated for fabric softening in the rinse and through-the-wash (by admixing with a detergent granule). Cotton towels, 65% polyester/35% cotton swatches and double knit polyester swatches were washed and tested for fabric softness in the compositions shown below. The washing was done in a 68 liter automatic washer at 120° F. in water of 12 grains/gal. hardness having a 3/1Ca/Mg ratio.

| Softener Composition No. | Blank | #4 | #5 |
|---|---|---|---|
| Detergent granule(1) | 87.48g. | 87.48g. | 87.48g. |
| Softener Composition | | | |
| added in rinse | — | 57.26g.(2) | — |
| added in the wash | — | — | 43.34g.(3) |

(1)The composition was 13.7% $C_{12}$LASNa, 6.85% $C_{14-16}$ alkyl $E_1$SNa, 39.5% STPP, 13.15% silicate solids (2SiO2/$Na_2O$), 18.9% $Na_2SO_4$, balance moisture + minors.

(2)The composition was 18.5% Brock clay combined with 3.7% primary tallow amine hydrochloride, 70.5% sodium carbonate and 7.4% surfactant (approx. sodium $C_{12}$ branched alkylbenzene sulfonate and added as a slurry in water.

(3)The composition was 62.3% Brock clay combined with 12% primary tallow amine hydrochloride, 25.2% $NaC_{12}$ branched alkyl benzene sulfonate and added as a slurry in water.

The fabrics were panel tested for softness as in Example I.

| | Blank | In the Rinse | Thru the Wash | LSD at 95% |
|---|---|---|---|---|
| Cotton towels | O(STD) | +3.3 | +1.6 | +0.4 |
| 65 poly/35 cotton | O(STD) | +1.1 | +1.0 | +0.9 |
| Double knit poly | O(STD) | +0.7 | −0.06 | +0.3 |

As noted above, fabric softening was noted for cotton towels and 65 poly/35 cotton both in the rinse and through the wash.

EXAMPLE III

Using the cool water washing procedure of Example I, cotton towels were evaluated for softness using the treatments shown in Example II.

| Softener Composition No. | Blank | #4 | #5 |
|---|---|---|---|
| Detergent granule(1) | 127.5g. | 127.5g. | 127.5g. |
| Softener Composition | | | |
| added in rinse | — | 57.26g.(2) | — |
| added in wash | — | — | 43.34g.(3) |
| Panel Score | | O(STD) + 3.2 + 3.0 | |
| LSD at 95% = 0.46 | | | |

(1)As in Example I
(2)As in Example II
(3)As in Example II

Fabric softening was again noted for cotton towels both in the rinse and through the wash.

EXAMPLE IV

Using the cool water washing procedure of Example I, cotton towels were evaluated for softness using the following treatments:

| Softener Composition No. | Blank | #2 | #6 |
|---|---|---|---|
| Detergent granule(1) | 127.5g. | 127.5g. | 127.5g. |
| Softener in 2nd rinse | — | 62.5g. | 50. g. |
| Softener Composition: | | | |
| Complex of Ca montmorillonite clay | — | 60.0% | 30.0% |
| Primary tallow amine hydrochloride | — | 3.0 | — |
| Ditallow dimethyl ammonium chloride | — | — | 4.5 |
| Branched $C_{12}$ alkylbenzene sulfonate, Na salt | — | 4.9 | 9.1 |
| Sodium toluenesulfonate | — | 0.5 | 0.9 |
| Sodium Carbonate | — | 15.5 | — |

-continued

| Softener Composition No. | Blank | #2 | #6 |
|---|---|---|---|
| Sodium Sulfate | — | 3.4 | 6.4 |
| Sodium Sesquicarbonate (anhyd. basis) | — | — | 37.7 |
| Water | — | 12.5 | 10.0 |
| Miscellaneous | — | Bal. | Bal. |

The results after two wash-rinse cycles are:

| Blank | #2 | #6 |
|---|---|---|
| -0- | +3.2 | +2.9 |

Least significant difference at 95% confidence=0.5

Composition #2 was prepared in slurry form as described in Example I. Composition #6 was prepared as follows:

2.25 g. of ditallowdimethylammonium chloride was dispersed in tap water at 70° C. The clay was added and the resulting slurry stirred for 10 minutes then cooled to room temperature. The remaining ingredients were predissolved in room temperature tap water. The resulting solution was mixed with the organo-clay slurry before addition to the second rinse.

Fabric softening was again noted for cotton towels for both types of fatty ammonium chloride salts.

EXAMPLE V

The following fabric softener compositions are prepared in accordance with the invention.

| Composition No. | 7 % | 8 % | 9 % | 10 % | 11 % | 12 % | 13 % |
|---|---|---|---|---|---|---|---|
| Complex of Sodium hectorite clay | 10 | | | | 25 | | |
| Sodium montmorillonite clay | | 80 | | 15 | | | 50 |
| Sodium saponite clay | | | 40 | | | 40 | |
| Primary tallow amine | | | 20 | | | | |
| Primary tallow amine hydrochloride | 3 | | | | | | 5 |
| Sec. dicoconut amine | | | | 3 | | | |
| Dicoconut dimethyl ammonium chloride | | 6 | | | | | |
| Tallow trimethyl ammonium chloride | | | | | 5 | | |
| Tetracoconut ammonium chloride | | | | | | 10 | |
| Sodium $C_{12}$LAS | 1.8 | 4.2 | 25 | 3.5 | 4 | 5 | 10 |
| Sodium $C_{14-16}$ alkyl $E_1S$ | | | | | 2 | | |
| Sodium toluene sulfonate | 0.2 | 0.4 | 3 | 0.4 | 0.4 | 0.5 | 1 |
| Sodium carbonate | | | 10 | | 26.5 | | |
| Sodium bicarbonate | | | | | 21 | | |
| Sodium sesquicarbonate (anhyd. basis) | 70 | 5 | | | | 32.5 | 22 |
| Sodium sulfate | | | | 67.1 | 4.8 | | |
| Water + minors (perfume, colorant, etc) | 15 | 4.8 | 2 | 12 | | 12 | 12 |

The above compositions can be used in the rinsing operation in the home laundering process to provide fabric softening.

Alternatively the above compositions can be admixed with detergent compositions to provide fabric softening through the wash.

EXAMPLE VI

The following fabric softener compositions are prepared in accordance with the invention.

| Composition No. | 14 | 15 | 16 |
|---|---|---|---|
| Complex of Brock clay | 60% | 60% | 60% |
| Palmityl methyl ethyl sulfonium chloride | 5 | | |
| Monostearyl trimethyl phosphonium chloride | | 5 | |
| 1 beta hydroxyethyl-2 stearyl imidazoline | | | 5 |
| Sodium $C_{12}$LAS | 6.5 | 6.5 | 6.5 |
| Sodium toluene sulfonate | 0.7 | 0.7 | 0.7 |
| Sodium sesquicarbonate (anhyd. basis) | 16.5 | 16.5 | 16.5 |
| Water + minors (perfume, colorant etc.) | 11.3 | 11.3 | 11.3 |

EXAMPLE VII

The following detergent composition is prepared.

| | |
|---|---|
| Complex of Brock Clay | 20% |
| Tallow dimethyl ammonium chloride | 4 |
| Sodium $C_{12}$LAS | 20 |
| Sodium toluene sulfonate | 3 |
| Sodium tripolyphosphate | 22 |
| Silicate solids | 8 |
| Sodium sulfate | 15.6 |
| Optical brightener | 0.2 |
| Blue color (Ultramarine Blue) | 0.1 |
| Perfume | 0.1 |
| Water | 7 |

EXAMPLE VIII

The effect of the presence of the organo-clay complex in fabrics on greasy/oil soil removal was tested.

Test swatches consisting of 100% double knit polyester and 100% cotton muslin were washed in a 1 gallon mini-washer with the detergent composition used in Example I under the following conditions:

| | |
|---|---|
| Product concentration | 0.25% (9.45 grams) |
| Water temperature | 70° F. |
| Water hardness | 9 grains/gal. 3:1 Mg:Ca ratio |
| Water:cloth ratio | 20:1 |
| Washing time | 20 minutes |

After washing, the test swatches were hand wrung and rinsed, with agitation, for 5 minutes in the mini-washer using 1 gallon of 70° F. water as above.

One-half of the test swatches were rinsed a second time following the procedure used in the first rinse. The other one-half of the test swatches were similarly rinsed a second time with the exception that the second rinse water included 3.78 grams of the fabric softening composition recited in Example I No. 1. All the test swatches were then hand wrung and line dried.

The test swatches were then visibly stained with dirty motor oil (DMO) or bacon grease and allowed to age for about 18 hours.

The test swatches of each soil type were washed separately using the washing conditions mentioned above with the exception that the water:cloth ratio was 25:1. Face cloths of 86% cotton/14% polyester were included to make up the fabric load.

The first rinse of the test swatches was done as before. The second rinse was done in 1.06 liters of water (water:cloth ratio 7:1) with no agitation. For the test swatches containing fabric softener the second rinse water contained 2.70 grams of the softener composition recited in Example I No. 1. After 5 minutes of static rinsing the sets of test swatches were hand wrung and line dried.

The unsoftened set of test swatches were then compared against the test swatches containing fabric softener for grease and oily soil removal using the grading technique in Example I. The results obtained were:

| | Panel Score Results | | |
|---|---|---|---|
| | No Softening Treatment | Softening Treatment | LSD at 95% |
| DMO on 100% polyester | 0(std) | +3.0 | 0.9 |
| DMO on 100% cotton | 0(std) | 0 | — |
| Bacon grease on 100% polyester | 0(std) | +2.0 | 1.1 |
| Bacon grease on 100% cotton | 0(std) | +1.0 | 0.3 |

The results show that the presence of the organo-clay softener provides a further benefit in that it aids in the removal of greasy and oily soils.

What is claimed is:

1. A fabric softening composition in solid form comprising:

(a) from about 10% to about 80% by weight of an impalpable smectite clay having an ion exchange capacity of at least 50 meq/100 grams;

(b) from about 1% to about 50% by weight of said clay of a compound selected from the group consisting of organic primary, secondary, and tertiary amines and their water soluble or water dispersible salts and organic quaternary ammonium, phosphonium and sulfonium compounds wherein said compounds have at least one hydrocarbon group having from 8 to 22 carbon atoms; and (c) an anionic surfactant present in the amount of at least 30% molar equivalence to component (b);

wherein components (a) and (b) are combined to form a complex prior to the addition of the anionic surfactant.

2. A composition according to claim 1 wherein the smectite clay is selected from the alkali metal and alkaline earth metal montmorillonites, saponites and hectorites.

3. A composition according to claim 2 wherein component (b) is selected from the group consisting of primary, secondary, and tertiary amine salts and quaternary ammonium compounds having the formulas $R_1R_2R_3N$;
$[R_1R_2R_3R_4N]_n{+}X^{n-}$ wherein $R_1$ represents an alkyl or alkenyl having from about 8 to about 22 carbon atoms, $R_2$, $R_3$ and $R_4$ each independently represent hydrogen or alkyl, alkenyl arylalkyl or alkylaryl having from 1 to 22 carbon atoms, n is an integer of from 1 to 3, and $X^-$ represents a water soluble or water dispersible anion.

4. A composition according to claim 1 which additionally contains from about 2% to about 75% of a water soluble filler.

5. A composition according to claim 3 wherein the anionic surfactant is present at room about 50% to about 100% molar equivalence of component (b).

6. A composition according to claim 5 wherein the anionic surfactant is selected from the group consisting of water soluble straight or branched chain alkyl benzene sulfonates or alkyl toluene sulfonates having from 9 to 15 carbon atoms in the alkyl portion, water soluble fatty acid soaps having from 10 to about 20 carbon atoms in the alkyl portion, water soluble alkyl sulfates having from 8 to 18 carbon atoms in the alkyl portion, and water soluble alkyl ether sulfates having from 8 to 18 carbon atoms in the alkyl portion and from about 1 to about 6 moles of ethylene oxide and mixtures thereof.

7. A composition according to claim 6 wherein component (b) is selected from the group consisting of primary tallow amine, primary tallow amine hydrochloride, monotallow dimethyl amine, monotallow dimethyl amine hydrochloride, tallow trimethyl ammonium chloride, ditallow dimethyl ammonium chloride, discoconut dimethyl ammonium chloride, ditallow methyl amine and ditallow methyl ammonium chloride.

8. A fabric softening composition consisting essentially of:

(a) from about 20% to about 60% by weight of an alkali metal montmorillonite clay;

(b) from about 3% to about 30% by weight of component (b) selected from the group consisting of primary, secondary and tertiary amine salts and quaternary ammonium compounds having the formulas $R_1R_2R_3N$;
$[R_1R_2R_3R_4N]_n{+}X^{n-}$ wherein $R_1$ represents an alkyl or alkenyl having from about 8 to about 22 carbon atoms $R_2$, $R_3$ and $R_4$ each independently represent hydrogen or alkyl, alkenyl, arylalkyl or alkylaryl having from 1 to 22 carbon atoms, n is an integer of from 1 to 3 and $X^-$ represents a water soluble or water dispersible anion;

(c) an anionic surfactant present in the amount of at least 50% molar equivalence to component (b) wherein the anionic surfactant is selected from the group consisting of water soluble straight or branched chain alkyl benzene sulfonates or alkyl toluene sulfonates having from 9 to 15 carbon atoms in the alkyl portion, water soluble fatty acid soaps having from 10 to about 20 carbon atoms in the alkyl portion, water soluble alkyl sulfates having from 8 to 18 carbon atoms in the alkyl portion, and water soluble alkyl ether sulfates having from 8 to 18 carbon atoms in the alkyl portion and from about 1 to about 6 moles of ethylene oxide, and mixtures thereof; and (d) from about 10 to about 50% by weight of water soluble fillers;

wherein components (a) and (b) are combined to form a complex prior to the addition of the other components.

9. A composition according to claim 8 wherein the filler is selected from the group consisting of sodium carbonate, sodium bicarbonate, sodium sesquicarbonate, sodium sulfate, magnesium sulfate, sodium chloride, urea, and mixtures thereof.

10. A detergent composition in solid form comprising:

(a) from about 10% to about 50% of a fabric softening composition comprising:
(i) from about 10% to about 80% of an impalpable smectite clay having an ion exchange capacity of at least 50 meq/100 grams;
(ii) from about 1% to about 50% by weight of said clay of a compound selected from the group consisting of organic primary, secondary, and tertiary amines and their water soluble or water dispersible salts and organic quaternary ammonium, phosphonium, and sulfonium compounds wherein said compounds have at least one hydrocarbon group having from 8 to 22 carbon atoms; and
(iii) an anionic surfactant present in the amount of at least 30% molar equivalence to component (b);
wherein (i) and (ii) are combined to form a complex prior to the addition of the anionic surfactant; and
(b) from about 50% to about 90% of a detergent composition comprising:
(i) from about 1% to about 50% of a surfactant selected from the group consisting of anionic surfactants and mixtures of anionic surfactants with minor amounts of nonionic, ampholytic and zwitterionic surfactants; and
(iii) from about 10% to about 60% by weight of an organic or inorganic builder salt.

11. A detergent composition according to claim 10 wherein the smectite clay is selected from the alkali metal and alkaline earth metal montmorillonites, saponites and hectorites.

12. A detergent composition according to claim 11 wherein component (a) (ii) is selected from the group consisting of primary, secondary, and tertiary amine salts and quaternary ammonium compounds having the formulas $R_1R_2R_3N$;

$[R_1R_2R_3R_4N]_n{+}X^{n-}$ wherein $R_1$ represents an alkyl or alkenyl having from about 8 to about 22 carbon atoms, $R_2$, $R_3$, and $R_4$ each independently represent hydrogen or alkyl, alkenyl arylalkyl or alkylaryl having from 1 to 22 carbon atoms, n is an integer of from 1 to 3 $X^-$ represents a water soluble or water dispersible anion.

13. A detergent composition according to claim 12 wherein component (b) (i) is an anionic surfactant and both components (a) (iii) and (b) (i) are selected from the group consisting of water soluble straight or branched chain alkyl benzene sulfonates or alkyl toluene sulfonates having from 9 to 15 carbon atoms in the alkyl portion, water soluble fatty acid soaps having from 10 to about 20 carbon atoms in the alkyl portion, water soluble alkyl sulfates having from 8 to 18 carbon atoms in the alkyl portion, and water soluble alkyl ether sulfates having from 8 to 18 carbon atoms in the alkyl portion and from about 1 to about 6 moles of ethylene oxide and mixtures thereof.

14. A detergent composition according to claim 13 wherein component (a) (ii) is selected from the group consisting of primary tallow amine, primary tallow amine hydrochloride, monotallow dimethyl amine, monotallow dimethyl amine hydrochloride, tallow trimethyl ammonium chloride, ditallow dimethyl ammonium chloride, dicoconut dimethyl ammonium chloride, ditallow methyl amine and ditallow methyl ammonium chloride.

15. A composition according to claim 14 wherein the detergency builder salt is selected from the group consisting of alkali metal, ammonium and alkanolammonium, polyphosphates, pyrophosphates, bicarbonates, carbonates silicates, borates nitrilotriacetates and citrates.

16. A method for imparting softness to fabrics which comprises contacting said fabrics with an aqueous dispersion of a fabric softening composition wherein said fabric softening composition comprises:
(a) from about 10% to about 80% by weight of an impalpable smectite clay having an ion exchange capacity of at least 50 meq/100 grams;
(b) from about 1% to about 50% by weight of said clay of a compound selected from the group consisting of organic primary, secondary, and tertiary amines and their water soluble or water dispersible salts and organic quarternary ammonium, phosphonium and sulfonium compounds wherein said compounds have at least one hydrocarbon group having from 8 to 22 carbon atoms; and
(c) an anionic surfactant present in the amount of at least 30% molar equivalence to component (b);
wherein components (a) and (b) are combined to form a complex prior to the addition of the anionic surfactant.

17. A method according to claim 16 wherein the smectite clay is selected from the alkali metal and alkaline earth metal montmorillonites, saponites and hectorites; component (b) is selected from the group consisting of primary, secondary, and tertiary amine salts and quaternary ammonium compounds having the formulas $R_1R_2R_3N$;

$[R_1R_2R_3R_4N]_n{+}X^{n-}$ wherein $R_1$ represents an alkyl or alkenyl having from about 8 to about 22 carbon atoms, $R_2$, $R_3$ and $R_4$ each independently represent hydrogen or alkyl, alkenyl arylalkyl or alkylaryl having from 1 to 22 carbon atoms, n is an integer of from 1 to 3, and $X^-$ represents a water soluble or water dispersible anion;
and component (c) is present at from about 50% to about 100% molar equivalence to component (b) and is selected from the group consisting of water soluble straight or branched chain alkyl benzene sulfonates of alkyl toluene sulfonates having from 9 to 15 carbon atoms in the alkyl portion, water soluble fatty acid soaps having from 10 to about 20 carbon atoms in the alkyl portion, water soluble alkyl sulfates having from 8 to 18 carbon atoms in the alkyl portion, and water soluble alkyl ether sulfates having from 8 to 18 carbon atoms in the alkyl portion and from about 1 to about 6 moles of ethylene oxide and mixtures thereof.

18. A method according to claim 17 wherein the fabric softening composition additionally contains from about 2% to about 75% of a water soluble filler.

19. A method according to claim 18 wherein the water soluble filler is selected from the group consisting of sodium carbonate, sodium bicarbonate, sodium sesquicarbonate, sodium sulfate, magnesium sulfate, sodium chloride, urea, and mixtures thereof.

20. A method according to claim 19 wherein component (b) is selected from the group consisting of primary tallow amine, primary tallow amine hydrochloride, monotallow dimethyl amine, monotallow dimethyl amine hydrochloride, tallow trimethyl ammonium chloride, ditallow dimethyl ammonium chloride and dicoconut dimethyl ammonium chloride, ditallow methyl amine and ditallow methyl ammonium chloride.

21. In a method of laundering fabrics, the simultaneous step of imparting softness to fabrics which comprises contacting said fabrics with an aqueous dispersion of a detergent composition wherein said detergent composition comprises:

(a) from about 10% to about 50% of a fabric softening composition comprising:

(i) from about 10% to about 80% of an impalpable smectite clay having an ion exchange capacity of at least 50 meq/100 grams;

(ii) from about 1% to about 50% by weight of said clay of a compound selected from the group consisting of organic primary, secondary, and tertiary amines and their water soluble or water dispersible salts and organic quarternary ammonium, phosphonium, and sulfonium compounds wherein said compounds have at least one hydrocarbon group having from 8 to 22 carbon atoms; and (iii) an anionic surfactant present in the amount of at least 30% molar equivalence to component (b);

wherein (i) and (ii) are combined to form a complex prior to the addition of the anionic surfactant; and (b) from about 50% to about 90% of a detergent composition comprising:

(i) from about 1% to about 50% of a surfactant selected from the group consisting of anionic surfactants and mixtures of anionic surfactants with minor amounts of nonionic, ampholytic and zwitterionic surfactants; and (ii) from about 10% to about 60% by weight of an organic or inorganic builder salt.

22. The method of claim 21 wherein the smectite clay is selected from the alkali metal and alkaline earth metal monotmorillonites, saponites and hectorites; component (a) (ii) is selected from the group consisting of primary, secondary and tertiary amine salts and quaternary ammonium compounds having the formulas $$R_1R_2R_3N;$$
$$[R_1R_2R_3R_4N]_n{}^+X^{n-}$$

wherein $R_1$ represents an alkyl or alkenyl having from about 8 to about 22 carbon atoms and $R_2$, $R_3$, and $R_4$ each independently represent hydrogen or alkyl, alkenyl arylalkyl or alkylaryl having from 1 to 22 carbon atoms, n is an integer of from 1 to 3 and $X^-$ represents a water soluble or water dispersible anion; component (b) (i) is an anionic surfactant and both components (a) (iii) and (b) (i) are selected from the group consisting of water soluble straight or branched chain alkyl benzene sulfonates or alkyl toluene sulfonates having from 9 to 15 carbon atoms in the alkyl portion, water soluble fatty acid soaps having from 10 to about 20 carbon atoms in the alkyl portion, water soluble alkyl sulfates having from 8 to 18 carbon atoms in the alkyl portion, and water soluble alkyl ether sulfates having from 8 to 18 carbon atoms in the alkyl portion and from about 1 to about 6 moles of ethylene oxide and mixtures thereof; and component (b) (ii) is selected from the group consisting of alkali metal, ammonium and alkanolammonium, polyphosphates, pyrophosphates, bicarbonates, carbonates, silicates, borates, nitrilotriacetates and citrates.

23. The method of claim 22 wherein component (a) (ii) is selected from the group consisting of primary tallow amine, primary tallow amine hydrochloride, monotallow dimethyl amine, monotallow dimethyl amine hydrochloride, tallow trimethyl ammonium chloride, ditallow dimethyl ammonium chloride and dicoconut dimethyl ammonium chloride, ditallow methyl amine and ditallow methyl ammonium chloride.

* * * * *